US005980434A

United States Patent [19]

Webber

[11] Patent Number: 5,980,434

[45] **Date of Patent: *Nov. 9, 1999**

[54] EXERCISE APPARATUS WITH ADJUSTABLE ROLLER PADS

[76] Inventor: Randall T. Webber, 11162 Morning Creek Dr., San Diego, Calif. 92128

[ * ] Notice: This patent is subject to a terminal disclaimer.

[21] Appl. No.: 09/050,709

[22] Filed: Mar. 30, 1998

Related U.S. Application Data

[63] Continuation-in-part of application No. 08/579,972, Dec. 28, 1995, Pat. No. 5,733,233.

[51] Int. Cl.[6] ..... A63B 23/04

[52] U.S. Cl. ..... 482/100; 482/134; 482/137; 482/138; 482/145; 482/908

[58] Field of Search ..... 482/80, 100, 137–140, 482/145, 908; 128/845, 882; 601/34, 35

[56] References Cited

U.S. PATENT DOCUMENTS

| | | |
|---|---|---|
| 3,850,430 | 11/1974 | Hamilton . |
| 4,448,412 | 5/1984 | Brentham . |
| 4,546,968 | 10/1985 | Silberman . |
| 4,575,077 | 3/1986 | Osborne et al. . |
| 4,635,933 | 1/1987 | Schnell . |
| 4,678,185 | 7/1987 | Mahnke . |
| 4,711,448 | 12/1987 | Minkow et al. . |
| 4,732,380 | 3/1988 | Maag . |
| 4,809,972 | 3/1989 | Rasmussen et al. . |
| 4,828,255 | 5/1989 | Lahman . |
| 4,858,915 | 8/1989 | Szabo . |
| 4,900,018 | 2/1990 | Ish, III et al. . |
| 4,964,632 | 10/1990 | Rockwell . |
| 5,085,430 | 2/1992 | Habing . |
| 5,236,406 | 8/1993 | Webber . |
| 5,338,274 | 8/1994 | Jones . |
| 5,419,751 | 5/1995 | Byrd et al. . |
| 5,518,477 | 5/1996 | Simonson . |
| 5,562,579 | 10/1996 | Sheikowitz . |
| 5,733,233 | 3/1998 | Webber ..... 482/137 |

*Primary Examiner*—Richard J. Apley
*Assistant Examiner*—Victor K. Hwang
*Attorney, Agent, or Firm*—Brown, Martin, Haller & McClain, LLP

[57] ABSTRACT

In a weight lifting exercise apparatus, a leg exercise station is provided. A leg exercise arm carrying leg engaging roller pads is pivotally mounted on a frame member of the support frame of the apparatus, and is linked to an exercise resistance such as a weight stack. An upper roller pad assembly is pivotally mounted on the frame member adjacent the leg exercise arm, and is freely movable between a down position engaging behind a user's knees for performing leg extension exercises, and a raised position resting on top of the user's thighs when performing leg curls or pull down exercises.

9 Claims, 9 Drawing Sheets

EXERCISE APPARATUS WITH ADJUSTABLE ROLLER PADS

CROSS-REFERENCE TO RELATED APPLICATIONS

This application is a Continuation-In-Part of application Ser. No. 08/579,972, filed Dec. 28, 1995, now U.S. Pat. No. 5,733,233.

BACKGROUND OF THE INVENTION

The present invention relates to exercise apparatus of the weight lifting type which includes exercise stations for exercising various different muscle groups. Each station is linked to a weight stack or other resistance device, normally by means of a pulley and cable linkage system. The invention is particularly concerned with a leg exercising station of a weight lifting machine for performing leg exercises in a seated position.

Normally, weight lifting exercise machines include apparatus for performing leg extension exercises, such as leg hamstring curls and leg extensions. Leg extensions are normally performed in a sitting position by lifting an arm carrying a roller at the end, the user pushing up against the roller with their lower leg. Leg curls are normally performed in a standing position, either using the same roller arm and lifting it with the back of the legs, or using a different exercise device such as ankle straps linked to the weight stack. When leg curls are performed in a standing position, only one leg can be exercised at a time, extending the length of the exercise period. Additionally, it is inconvenient to have to move into different positions to perform different types of exercises. One example of this type of apparatus is described in U.S. Pat. No. 4,900,018 of Ish, III et al.

Leg exercise stations have been proposed in the past which permit leg extensions and leg curls to be performed in a sitting position, but require use of a seat belt to hold the body down when performing leg curls.

SUMMARY OF THE INVENTION

It is an object of the present invention to provide a new and improved leg exercise station for a weight lifting machine.

According to the present invention, an exercise apparatus is provided which comprises a support frame, a seat assembly mounted on the frame, a resistance device on the frame for providing resistance to exercises performed on the apparatus, a leg exercise arm pivotally mounted on the frame at a location spaced forwardly from the seat assembly, the leg exercise arm having leg engaging members such as roller pads for engagement by a user's legs when seated on the seating assembly to perform leg extension and leg curl exercises, the leg exercise arm being linked to the resistance device for providing resistance to leg exercises, and a roller pad assembly adjustably mounted on the frame adjacent the leg exercise arm and movable between a down position in which the roller pad assembly engages behind a user's knees for providing a support surface while the user is performing leg extension exercises and a raised position in which the roller pad assembly engages on top of a user's thighs for providing a bearing surface and resisting raising of the user's legs while performing leg curl exercises.

Preferably, the roller pad assembly is pivotally mounted on a seat supporting portion of the frame at a location spaced forwardly of the seat, and a stop surface on the frame prevents downward movement of the pad assembly beyond the down position behind a seated user's knees. The roller pad assembly pivots freely upwards from the down position into a raised position resting on the user's thighs, so that it adjusts automatically for different leg sizes. In a preferred embodiment of the invention, the roller pad assembly comprises a U-shaped bracket for engaging over a seat supporting arm of the frame in the down position of the pad assembly, and first and second roller pads extending transversely from opposite arms of the U-shaped bracket. The bracket is pivotally mounted on the seat supporting arm. When the user wishes to perform leg curl exercises, they simply lift the bracket and roller pads upwardly, position their legs beneath the respective first and second roller pads, and then lower the assembly until the pads rest on the opposite thighs of the user. The user can then perform leg curl exercises with the lower ends of his or her legs positioned in front of the roller, and push back against the roller arm to move it rearwardly against the resistance of the weight stack or other resistance device.

With this arrangement, it will be easy and convenient to perform both leg curl and leg extension exercises while seated in the same position, simply by adjusting the position of a roller pad assembly between a location resting on the user's thighs and a position behind the user's knees. Both legs can be exercised simultaneously when performing leg curls, unlike previous arrangements in which it was necessary to perform leg curls in a standing position.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 1:
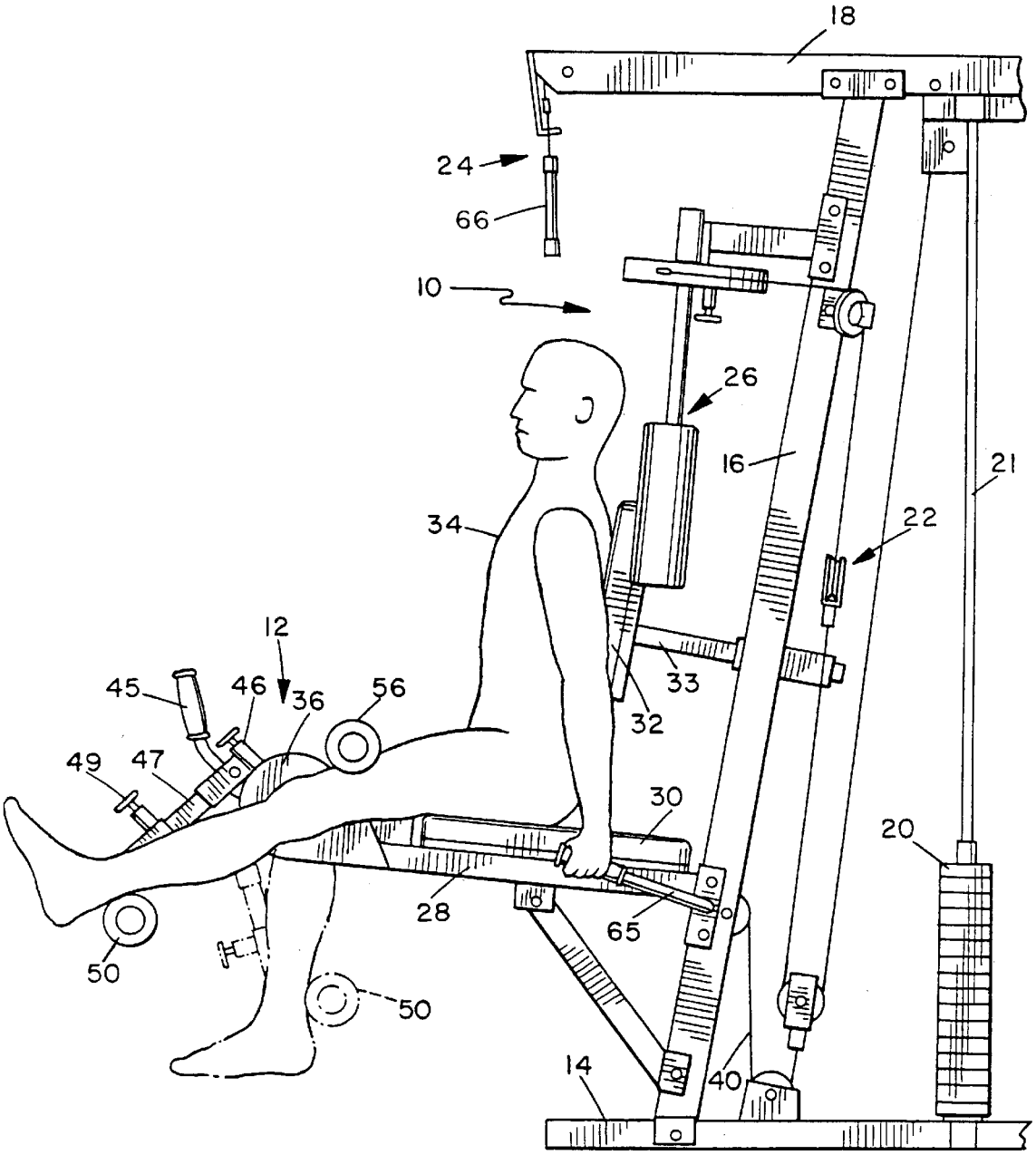
FIG. 1 is a side elevational view of an exercise apparatus with an adjustable roller pad assembly according to a first embodiment of the invention, illustrating the roller pads in a first position for performing leg curls.

The drawings illustrate an exercise apparatus 10 of the weight lifting type incorporating a leg exercise station 12 according to a first embodiment of the present invention. The apparatus 10 includes a support frame having a base 14, a forward upright 16, and an upper crossbar 18. A conventional weight stack 20 is slidably mounted on guide rods 21 which extend from the base 14 to the crossbar 18. The weight stack is linked via a cable and pulley mechanism 22 to various exercise stations, including the leg exercise station 12, pull down station 24, chest station 26, and other exercise stations which are not illustrated in the drawings.

Figure 2:
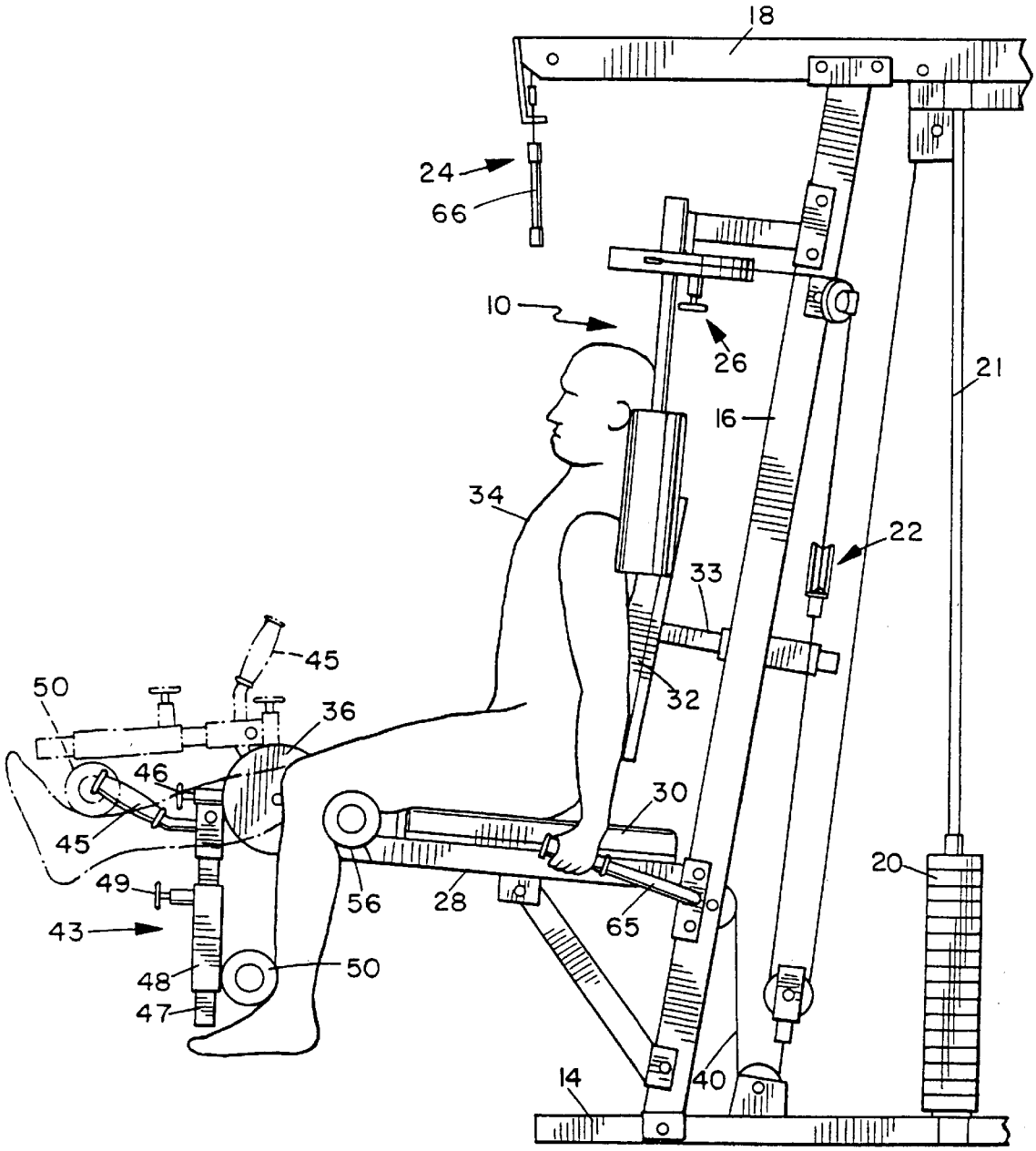
FIG. 2 is a side elevational view similar to FIG. 1 illustrating the roller pads in a second position for performing leg extensions.

A seat supporting arm 28 is secured to the upright 16 so as to project forwardly from the upright, and supports a seat pad 30 in a conventional manner. A backrest 32 is adjustably mounted on the upright 16 via adjustable mounting arm 33 at an appropriate location for providing a back support to an individual 34 seated on pad 30, as best illustrated in FIGS. 1 and 2. Arm 28 projects forwardly from seat pad 30 and supports the leg exercise station 12.

Figure 3:
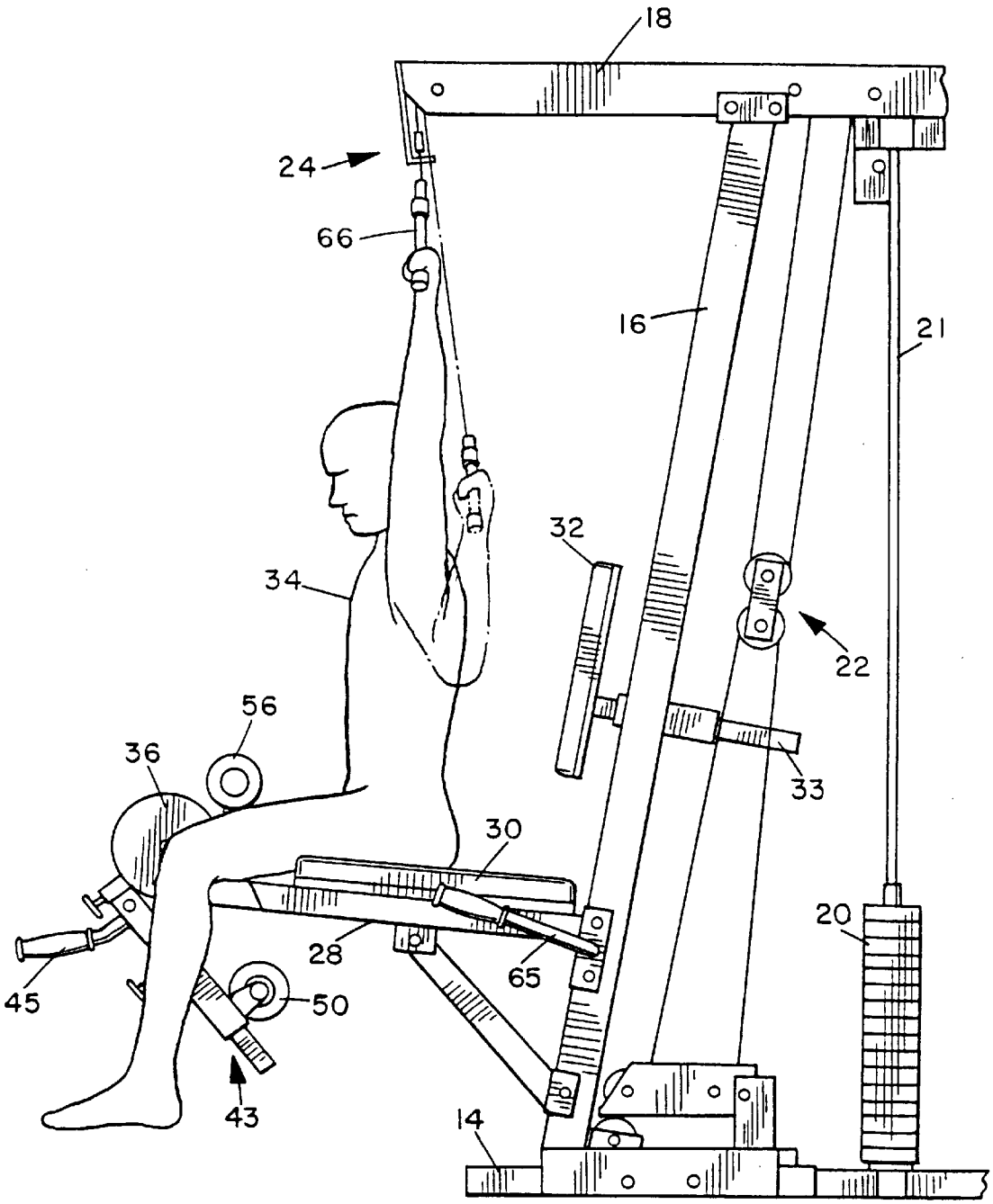
FIG. 3 is another side elevational view illustrating the apparatus in a different position for performing pull down exercises.
Figure 4:
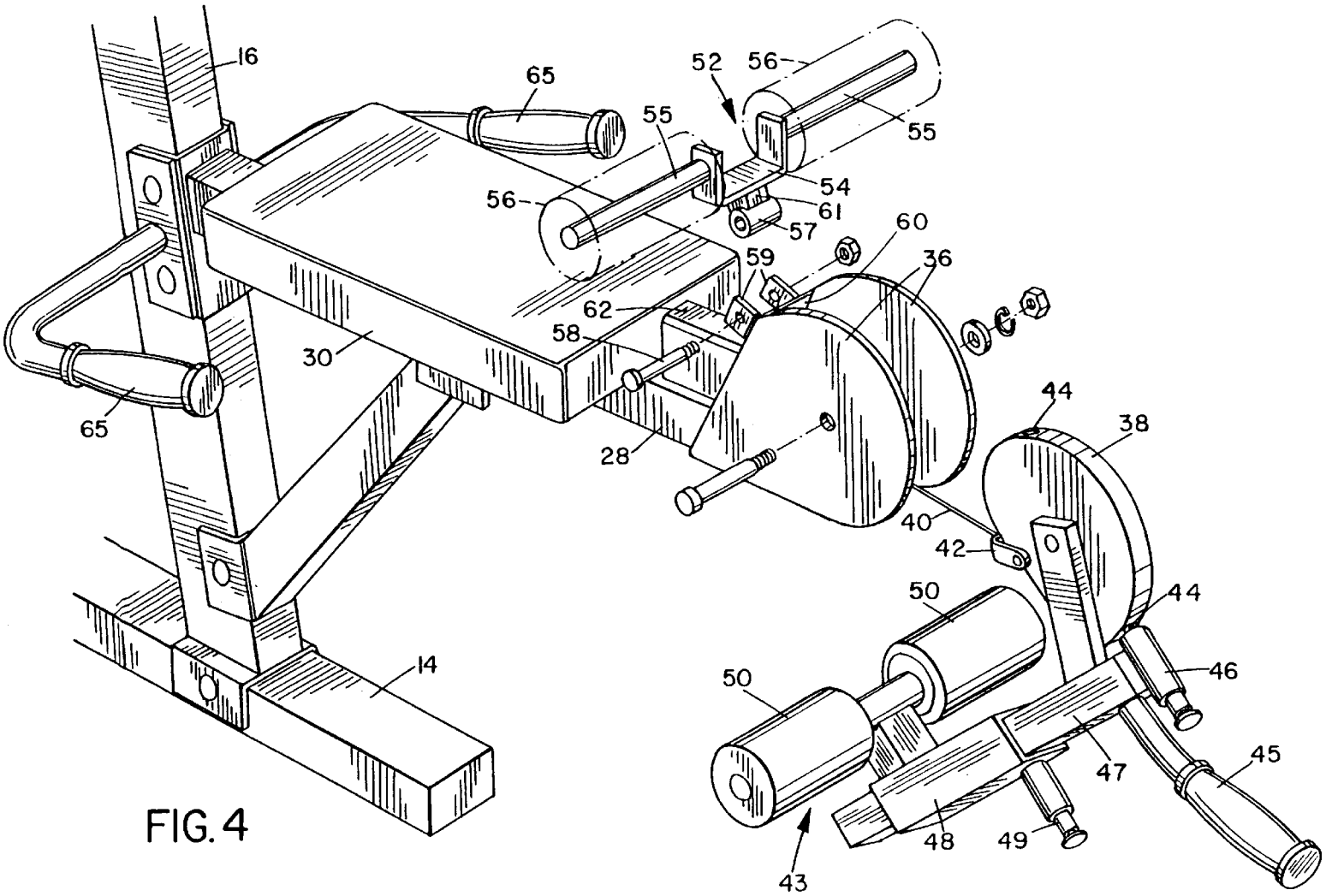
FIG. 4 is an exploded perspective view of the leg exercise station and adjustable roller pad assembly of FIGS. 1–3.
Figure 6:
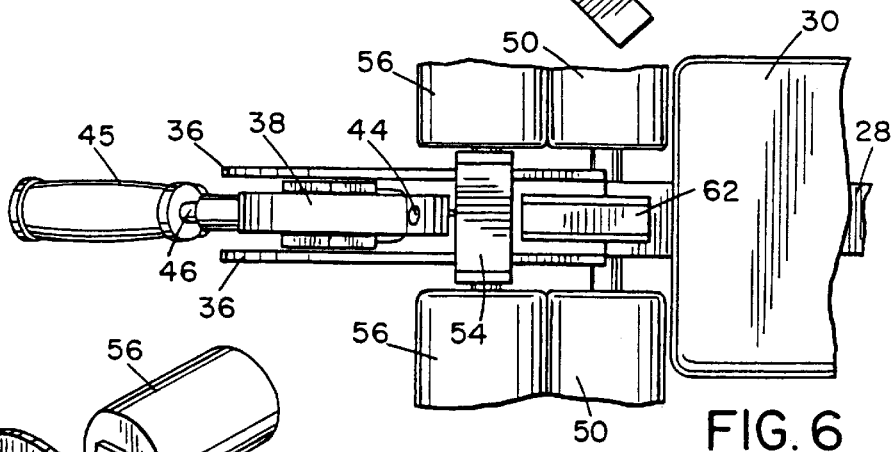
FIG. 6 is a top plan view of the leg exercise arm and adjustable roller pads.

Leg exercise station 12 includes a pair of spaced, parallel mounting plates 36 projecting from the forward end of arm 28, and a bi-directional pulley 38 rotatably mounted between plates 36, as illustrated in FIGS. 4 and 6. Pulley 38 is attached to cable 40 of the cable and pulley linkage via a swivel member 42 so that the cable may be wrapped in either direction around pulley 38. A leg exercise arm 43 of adjustable length is secured to pulley 38 via spring-loaded locking pin 46 which is secured to arm 43 and extends through an aligned opening 44 in the perimeter of pulley 38, as illustrated in FIG. 4. A series of spaced openings 44 are provided to allow the leg exercise arm to be secured to the pulley in any one of several possible positions. A handle 45 allows the user to move the arm readily between the inoperative position of FIG. 3, the leg extension position of FIG. 2, and the leg curl position of FIG. 1. The spring-loaded locking pin 46 is retracted to allow the angular orientation of arm 43 to be adjusted, and is released to lock the arm on the pulley 38 in any one of the selected positions.

Arm 43 includes an inner tubular portion 47 and an outer sleeve 48 which is releasably securable to inner portion 47 at a selected position via locking or pop pin 49. A pair of roller pads 50 are mounted adjacent the end of sleeve 48 for engagement by a user's legs when performing either leg extension or leg curl exercises. Thus the position of the roller pads can be adjusted to accommodate user's with different length legs.

Figure 5:
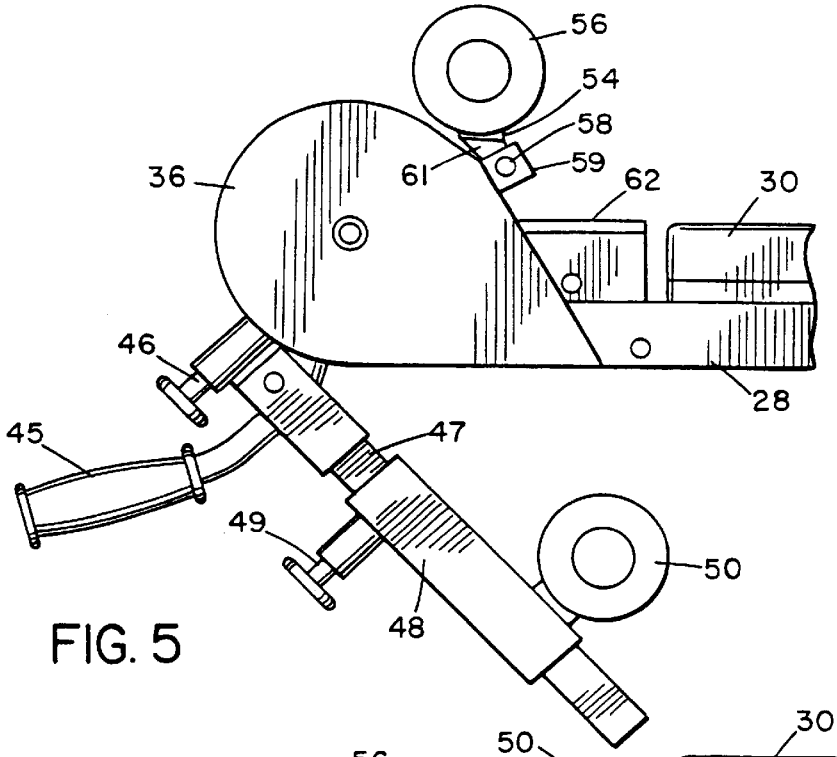
FIG. 5 is an enlarged side elevational view of the leg exercise arm and adjustable roller pad assembly.
Figure 7:
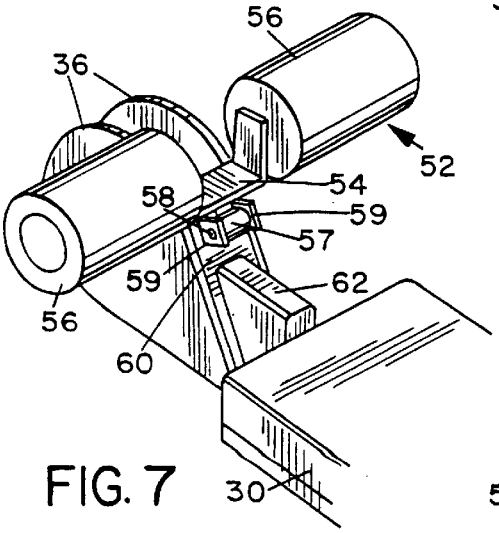
FIG. 7 is a rear perspective view of the leg exercise station illustrating the adjustable roller pad assembly in a raised position.
Figure 8:
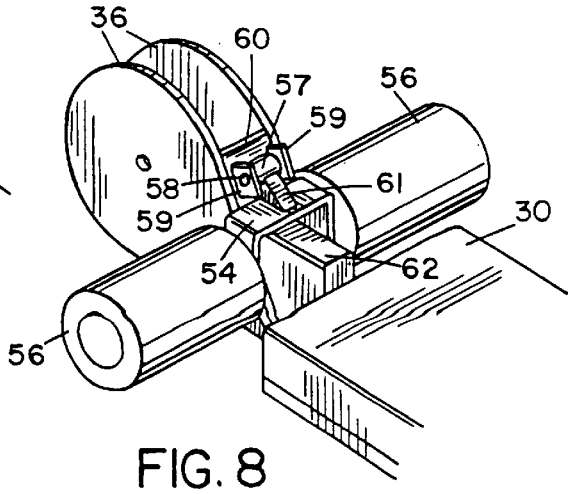
FIG. 8 is a view similar to FIG. 7 illustrating the adjustable roller pad assembly in a lowered position.

An adjustable second roller pad assembly or swing arm 52 is pivotally mounted on plates 36 adjacent the end of the seat supporting arm 28, as best illustrated in FIGS. 4–8. As best illustrated in FIG. 4, the assembly 52 basically comprises a central, U-shaped bracket 54 with roller support rods 55 projecting in opposite directions from the opposite arms of the bracket, and a pair of roller pads 56 mounted on the respective rods 55. A pivot sleeve 57 is secured to the center of bracket 54 for rotatable engagement over pivot pin 58 extending between end plates 59. Plates 59 are secured to plate 60 which extends between the rear edges of parallel plates 36, as best illustrated in FIGS. 4, 7 and 8. The pivot sleeve 57 is secured to the bracket 54 via angled arm 61 so that the sleeve is offset to one side of the bracket, as best illustrated in FIG. 5. A generally rectangular seating bracket 62 is secured to the forward end of support arm 28 between the front edge of seat pad 30 and the pulley support plates 36, so as to project upwardly to about the level of seat pad 30, as best illustrated in FIGS. 5, 7 and 8. The bracket 62 forms a stop defining the lowermost position of the roller pad assembly 52. When the roller pads 56 are rotated in a clockwise direction, the U-shaped bracket 54 will be seated over bracket 62 as illustrated in FIGS. 2 and 8, holding the roller pads 56 in their lowermost position. In this position, the pads will be located behind the knees of a user in a seated position on seat pad 30, as illustrated in FIG. 2, to provide support for performing leg extension exercises. The bracket 62 also forms a pulley housing for a pulley (not illustrated) mounted inside bracket 62 and seat supporting arm.

When the roller pad assembly is rotated in an anti-clockwise direction upwardly from the position illustrated in FIG. 8 to the position illustrated in FIG. 7, it may be placed on top of the seated user's thighs, if desired, as illustrated in FIGS. 1 and 3. In this position, the roller pads act to hold down the user's legs when performing leg curls as in FIG. 1 or pull down exercises as in FIG. 3. If the user is performing upper body exercises in a seated position, the leg exercise arm 43 will be pulled back and locked in the retracted position, as illustrated in FIG. 3. Where the user is performing pull down exercises by pulling down on the handle bar 66 at pull down station 24, the adjustable roller arm should first be raised. The user then sits in a comfortable, forward position on seat pad 30 below the pull down station, and the roller pads 56 are lowered until they rest on the user's thighs, as illustrated in FIG. 3. In this position, the roller pads act to hold down the user's legs while the exercises are performed.

If the user wishes to perform leg curl exercises, the exercise arm 43 is moved to the raised position as illustrated in solid lines in FIG. 1, with the roller pads 56 still resting on the user's thighs to hold down the legs. The user rests both ankles on top of the respective exercise arm roller pads 50 as illustrated, and pushes back into the dotted line position, repeating the exercise as often as desired. Handles 65 are mounted on upright 16 at an appropriate height for gripping by the user for support when performing leg exercises, as illustrated in FIG. 1.

In order to perform leg extension exercises, the adjustable roller pad assembly is lowered into the lowermost position, and the leg exercise arm 43 is adjusted into the intermediate position illustrated in solid lines in FIG. 2. The user then sits on the seat with the roller pads 56 positioned behind the user's knees and the roller pads 50 on arm 43 positioned in front of the user's ankles. The user then grips handles 65 and pushes arm 43 forwards with both legs into the dotted line position of FIG. 2. This movement is repeated as often as desired.

The adjustable roller arm assembly thus permits leg extension and leg curl exercises to be performed readily in a sitting position, exercising both legs simultaneously in each case. Seat belts and the like are not needed to hold the user down while carrying out leg curls or pull down exercises, unlike some previous arrangements. Instead, the roller pads 56 resting on the user's thighs stop the legs from popping up and also give the leg biceps or hamstring room to flex completely, which would not be possible if the roller pads 56 were located behind the user's knees. It is also advantageous to perform leg curls in a sitting position, rather than in a standing position as in some previous machines, since better back support is provided, reducing the risk of strain. When positioned in the down position behind the user's knees, the roller pads 56 hold the knees in the correct position and provide support under the leg while performing kick up or leg extension exercises.

Figure 9B:
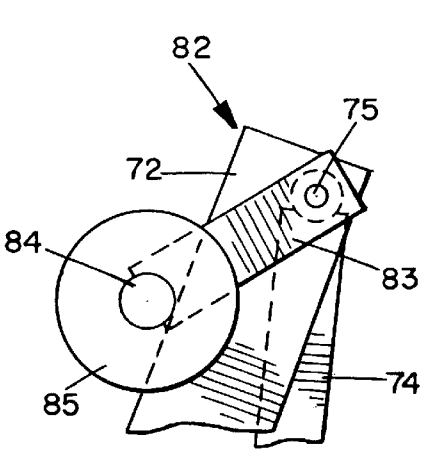
FIG. 9B is a view similar to FIG. 9A illustrating the roller pads in position for performing leg extensions.
Figure 9A:
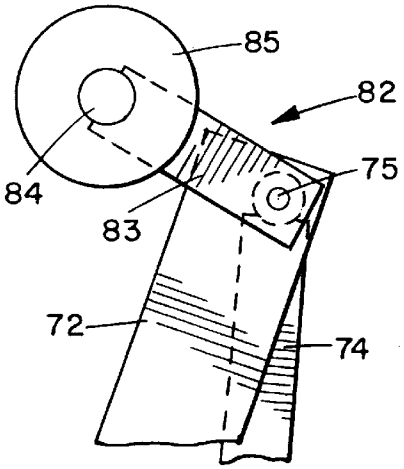
FIG. 9A is an exploded view of the upper part of the leg exercise arm of FIG. 9, illustrating one possible position of the roller pads.
Figure 9C:
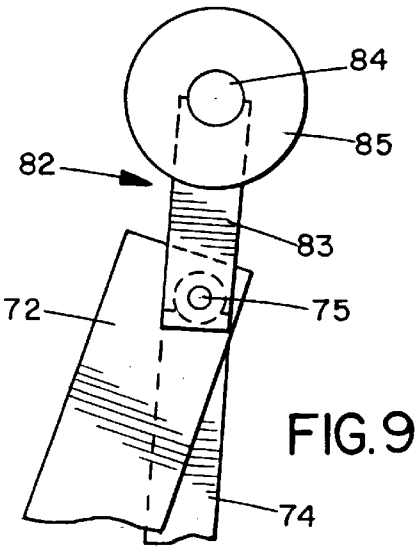
FIG. 9C is a view similar to FIGS. 9A and 9B illustrating the roller pads in another possible position.
Figure 9:
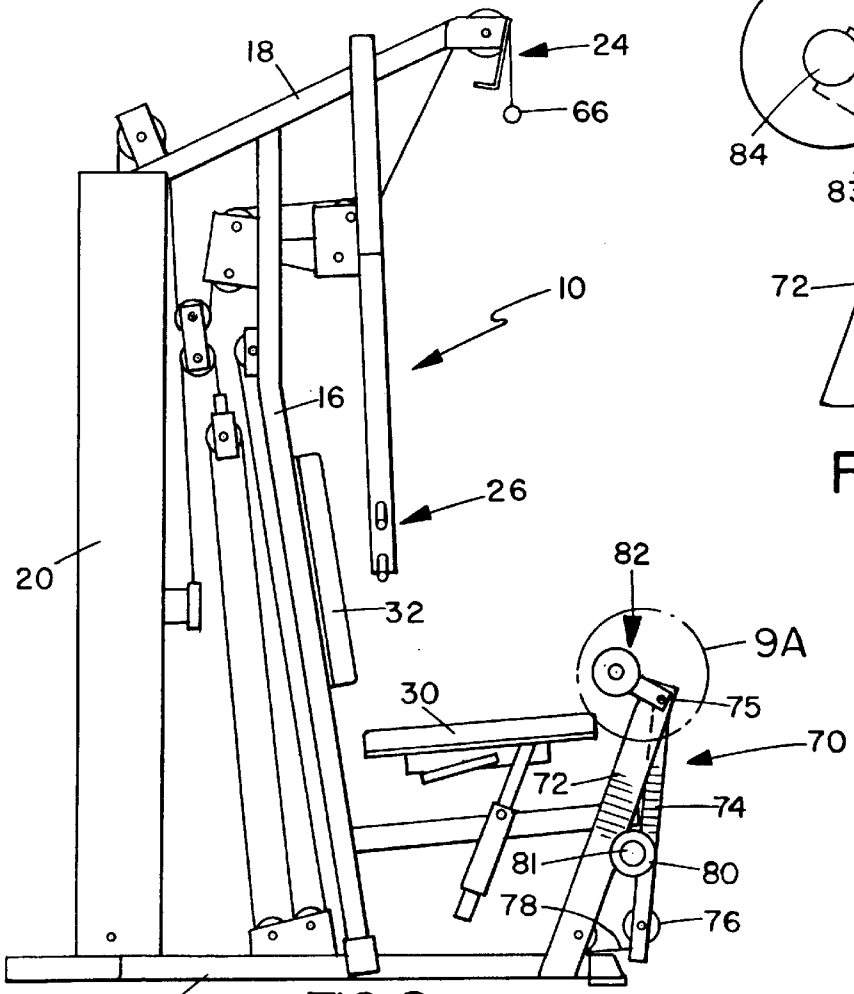
FIG. 9 is a side elevation view of an exercise apparatus with an adjustable roller pad assembly according to a second embodiment of the invention.

FIG. 9 illustrates an exercise apparatus 10 similar to that of FIG. 1 but incorporating a leg exercise station 70 according to a second embodiment of the invention, as illustrated in more detail in FIGS. 10 to 14. The remainder of the machine is similar to that of FIG. 1, and like reference numerals have been used for like parts as appropriate.

A pair of spaced, parallel, upright and forwardly inclined struts 72 project upwardly from the forward end of lower strut or base 14 and in front of the seat pad 30. A leg extension arm 74 is pivoted at one end between the upper ends of struts 72 via pivot pin 75. A pulley 76 is mounted adjacent the free end of arm 74, and is secured to the load bearing cable 78. A pair of roller pads 80 are mounted at opposite ends of a rod or axle 81 secured to the rear face of arm 74 at an intermediate position in its length. The roller pads 80 may be fixed or adjustable in position on arm 74. In this case, unlike the previous embodiment, the leg extension arm is one-directional.

Figure 14:
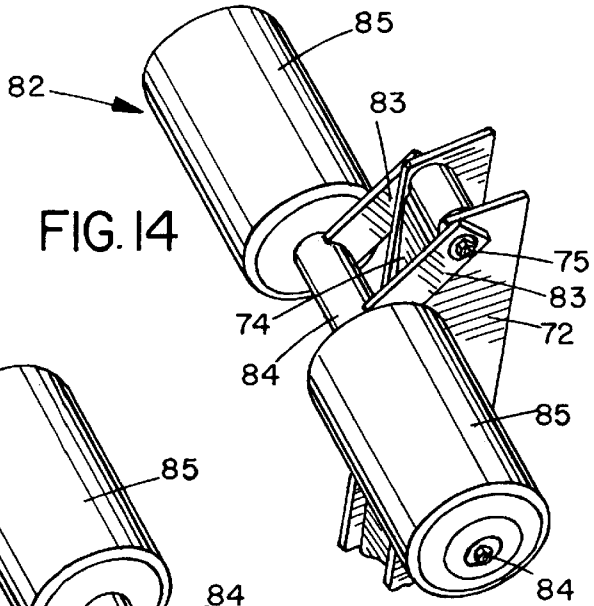
FIG. 14 is an enlarged perspective view of the roller pad assembly of FIG. 9.
Figure 14A:
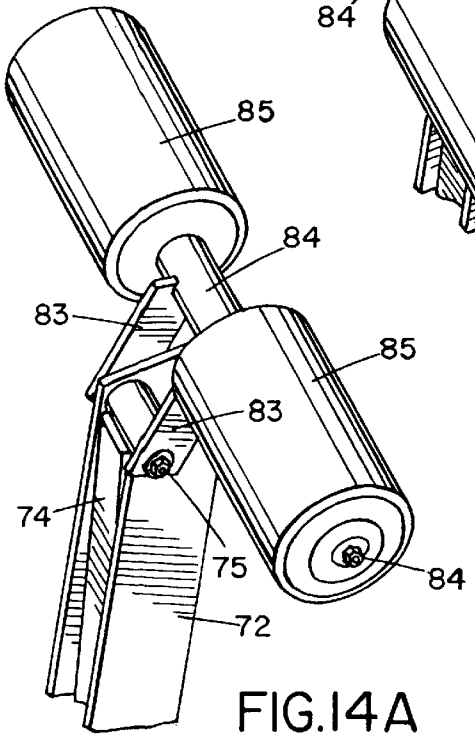
FIG. 14A is a view similar to FIG. 14 illustrating the roller pads in a different position.

As best illustrated in FIGS. 14 and 14A, an upper roller pad assembly 82 is hinged to the upper ends of struts 72. The assembly 82 comprises a pair of parallel support brackets 83 which are each hinged at one end to the upper ends of the respective struts 72 via the same pivot pin 75 as the arm 74. A rod or axle 84 is secured across the opposite ends of the support brackets, and a pair of upper roller pads 85 are mounted at opposite ends of axle 84. The roller pad assembly 82 is free-swinging and does not lock in place. FIGS. 9A, 9B, and 9C illustrate a series of possible positions for the roller pads 85.

Figure 10:
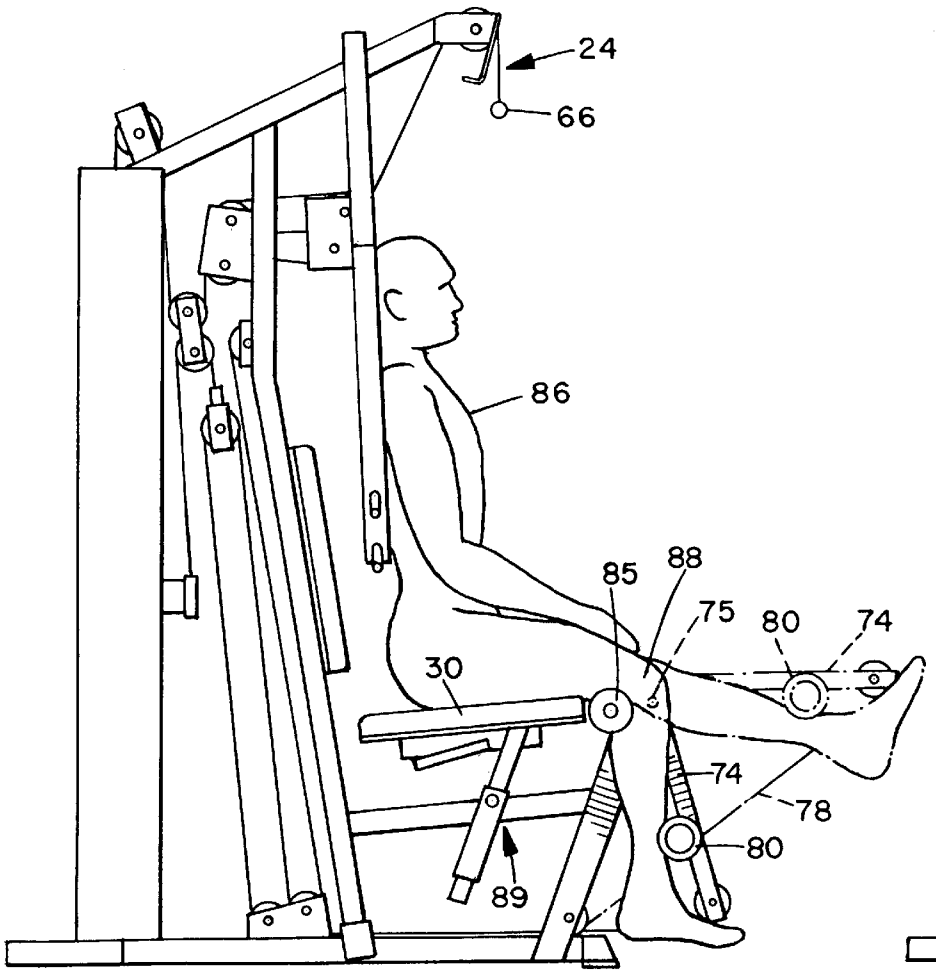
FIG. 10 is a side elevation view similar to FIG. 9 illustrating the roller pad positioning while performing leg extension exercises.

FIG. 9A illustrates a rearwardly directed position of the rollers 85. FIG. 9B illustrates a position in which axle 84 rests against the rear edges of the front upright struts 72 of the frame. FIG. 10 illustrates the leg extension arm in use with a seated exerciser 86 performing leg extensions, with the upper rollers 85 in the position illustrated in FIG. 9B. The rollers 85 fit under the user's knee 88 to keep the pivot point of the knee in line with the pivot axis 75 of the exercise arm, producing a more natural exercise motion.

Figure 11:
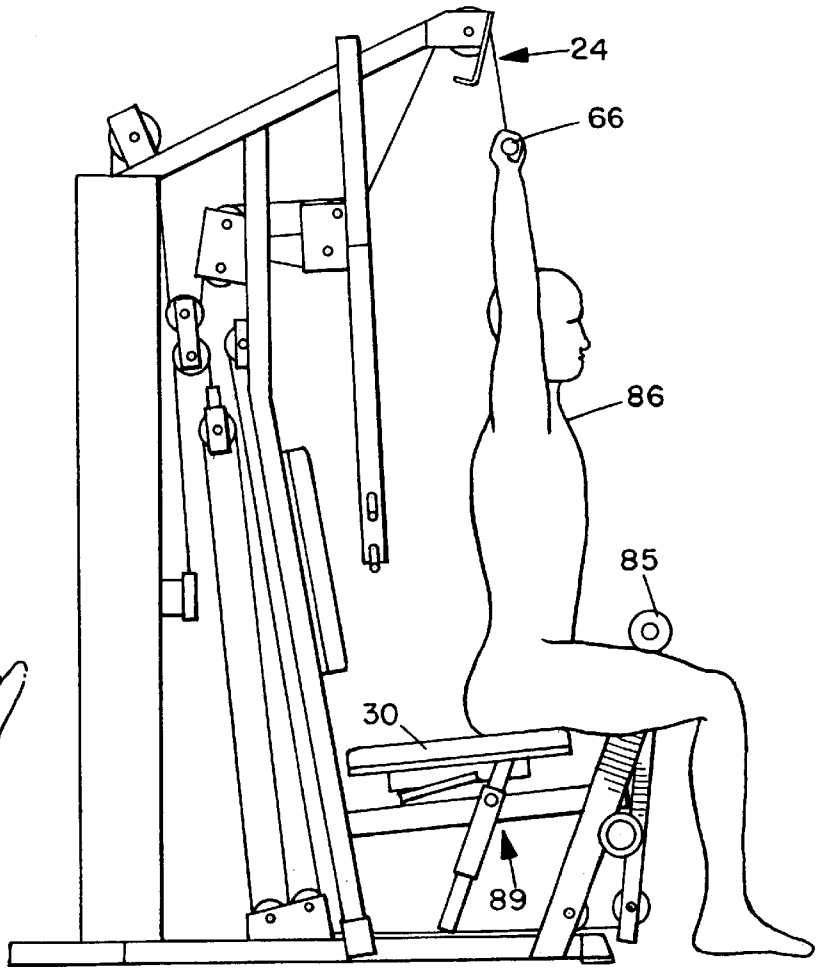
FIG. 11 is a side elevation view similar to FIGS. 9 and 10 illustrating the roller pad position while performing pull-down exercises.

FIG. 9C illustrates the roller pads 85 in an upper position, while FIG. 11 illustrates the use of the roller pads 85 positioned as in FIG. 9C as a knee hold down device while an exerciser performs pull down exercises with handle bar 66 of pull down station 24. The seat pad 30 adjusts downwardly via telescopic adjustment assembly 89 to let the user's thigh fit under the roller pads. Because the seat has a fixed increment adjustment and the pads 85 are free-swinging, the pads will self align for an optimum fit over the user's thighs, as indicated in FIG. 11.

Figure 12:
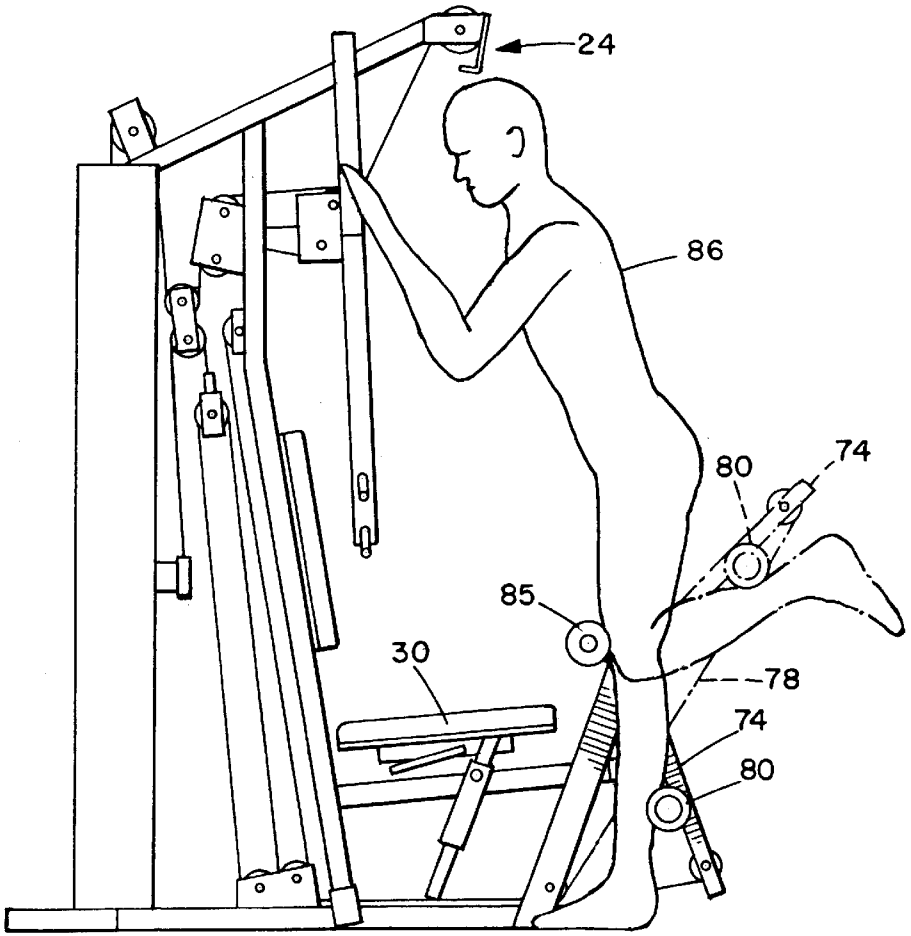
FIG. 12 is a side elevation view illustrating a user performing standing leg curls.

FIG. 12 illustrates the leg exercise station in use while performing standing leg curls. The user stands facing the machine with their thighs engaging upper roller pads 85 just above the knees, and the roller pads 80 engaging behind the user's calves. The user then kicks or rotates one leg back between the solid line position and the dotted line position illustrated in FIG. 12. Again, the upper roller pads 85 will keep the user's knee joint in line with the axis of rotation of the leg exercise arm 74.

Figure 13:
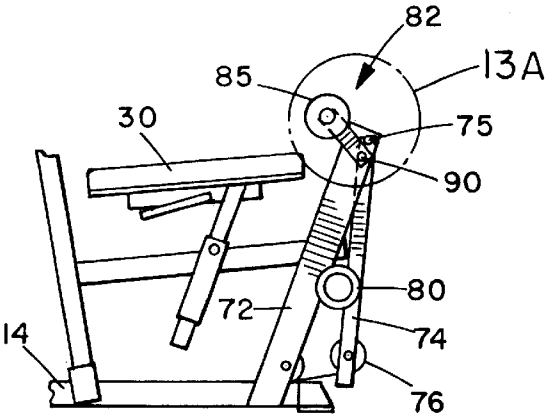
FIG. 13 is a partial side elevation view illustrating a modification of the upper roller pad assembly of FIG. 9.
Figure 13A:
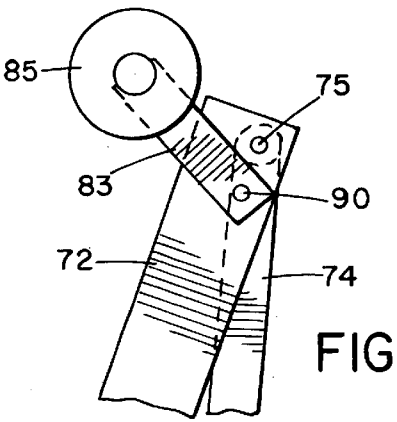
FIG. 13A is an enlarged view of the roller pad assembly of FIG. 13.

Although the upper roller pad assembly hinges at the same location as the leg exercise arm 74 in the embodiment illustrated in FIGS. 9 to 12, it may alternatively be hinged at a different location, as illustrated in FIGS. 13 and 13A. In this alternative, the roller support brackets 83 are each hinged to the upright struts 72 via pivot pin 90, located beneath and spaced from the exercise arm pivot 75. The assembly is otherwise identical to that of FIGS. 9 to 12, and like reference numerals have been used for like parts, as appropriate. The roller pad assembly operates in the same way in this embodiment as in the previous embodiment, and provides the same benefits.

Figure 15A:
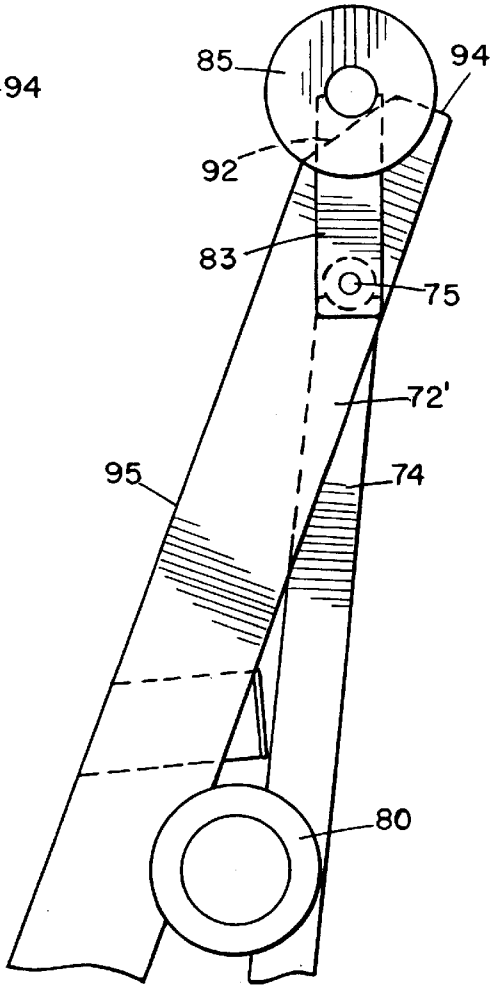
FIG. 15A is a view similar to FIG. 15 with the roller pads in a different position.
Figure 15:
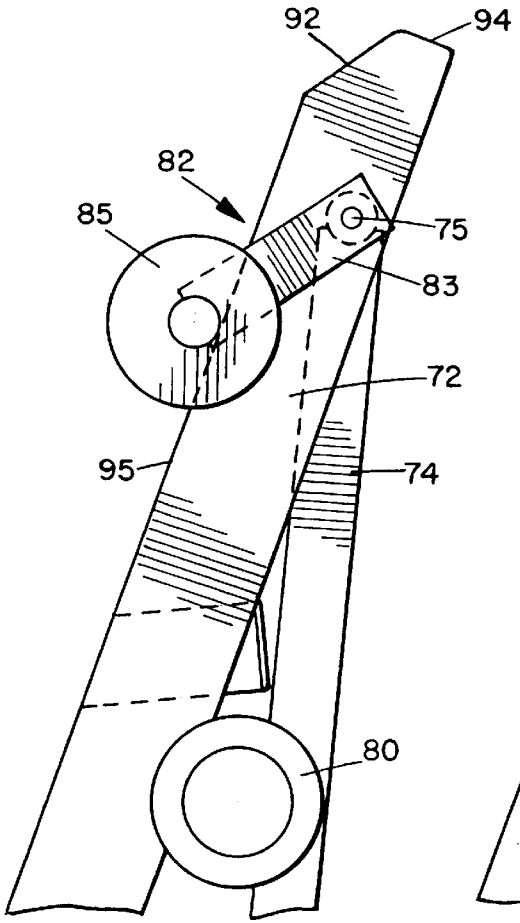
FIG. 15 is a side elevation view of a modified upper roller pad assembly.

FIGS. 15 and 15A illustrate another modified embodiment of the leg exercise station, in which like reference numerals have been used for like parts. In this embodiment, the upright struts 72' are extended upwardly, and each strut 72' has a rearwardly directed, inclined edge 92. The upper roller pad assembly 82 is pivoted to the struts via the same pivot pin 75 as the exercise arm 74, and the pivot point is spaced below the upper ends 94 of the struts 72'. In this modified embodiment, the axle 84 of the upper roller pads rests against the front edge 95 of the struts 72' in the lower position of FIG. 15, and rests against the inclined edges 92 in the upper position of the roller pad assembly, as illustrated in FIG. 15A. This position allows the user to use the rollers 85 as an arm brace when performing preacher curls. Although the roller pad assembly is illustrated pivoting at the same location as the exercise arm, i.e. pivot 75, it may alternatively be pivoted in a different location, for example as illustrated in FIGS. 13 and 13A. This arrangement provides two different stop positions for the upper roller pads without needing a locking pin, permitting adjustment between the positions to be made quickly and easily.

In prior art upper roller pad arrangements, the roller pads are rigidly fixed in place and must be manually adjusted and locked in position to fit each individual user. Because the pads are rigidly fixed, they will not adjust to the movement of the user's knee or to other movements such as expansion and contraction of the thigh muscles when positioned above the user's thighs. The roller pad assembly of this invention is free swinging and will move to adjust to the movement of a user's knee or thigh muscles, and is also adjustable for different users, without requiring release or re-locking of any lock pin or the like.

The adjustable roller arm assembly may be mounted on any multi-exercise weight machine in an equivalent position adjacent the seat pad to permit both leg extensions and leg curls to be performed in a sitting position.

Although a preferred embodiment of the invention has been described above by way of example only, it will be understood by those skilled in the field that modifications may be made to the disclosed embodiment without departing from the scope of the invention, which is defined by the appended claims.

I claim:

1. An exercise apparatus, comprising:

a support frame having a forward end and a rear end;

a seat assembly mounted on the frame for performing exercises in a seated position;

a resistance device mounted on the frame for providing resistance to exercises performed on the apparatus;

a leg exercise arm pivotally mounted on the frame at a location spaced forwardly from the seat assembly for rotation about a first pivot axis, wherein the leg exercise arm is linked to the resistance device for providing resistance to leg exercises in both a forward pivotal direction and a rearward pivotal direction, and has leg engaging members for engagement by a user's legs when seated on the seat assembly to perform leg exercises;

a roller pad assembly pivotally mounted on the frame adjacent the leg exercise arm, and having a pair of roller pads for engaging a user's legs, wherein the roller pad assembly is movable between a lowered position in which the roller pads are located behind a seated user's knees and a raised position in which the roller pads engage the top of a seated user's thighs, and the roller pads rest freely on top of a user's thighs in said raised position, whereby said roller pads can move up and down to accommodate thigh movement;

the roller pad assembly comprising a roller support member having a central portion pivotally mounted on the frame and a pair of axle portions projecting in opposite directions from said central portion, and each roller pad comprises a cylindrical pad having a central bore engaging over a respective one of said axle portions; and the roller pads comprising means for providing a support surface for performing leg extension exercises and for holding down the legs when performing upper body exercises.

2. The apparatus as claimed in claim 1, wherein the frame includes a base, an upright member projecting upwardly from the base, a seat supporting member projecting forwardly from the upright member and having a forward end, the seat assembly including a seat pad mounted on the seat supporting member, and at least a first upright strut projecting upwardly from the base and having an upper end spaced forwardly from said seat pad, and the leg exercise arm and roller pad assembly are pivotally mounted to the upright strut.

3. The apparatus as claimed in claim 2, wherein the roller pad assembly is pivoted about a second pivot axis spaced from the first pivot axis of the leg exercise arm.

4. An exercise apparatus, comprising:

a support frame having a forward end and a rear end;

a seat assembly mounted on the frame for performing exercises in a seated position;

a resistance device mounted on the frame for providing resistance to exercises performed on the apparatus;

a leg exercise arm pivotally mounted on the frame for rotation about a first pivot axis at a location spaced forwardly from the seat assembly, wherein the leg exercise arm is linked to the resistance device for providing resistance to leg exercises, and has leg engaging members for engagement by a user's legs when seated on the seat assembly to perform leg exercises;

a roller pad assembly pivotally mounted on the frame adjacent the leg exercise arm for rotation about the first pivot axis, wherein the leg exercise arm and roller pad assembly are pivoted about the same pivot axis, the roller pad assembly having a pair of roller pads for engaging a user's legs, the assembly is movable between a lowered position in which the roller pads are located behind a seated user's knees and a raised position in which the roller pads engage the top of a seated user's thighs, the roller pads resting freely on top of a user's thighs in said raised position, whereby said roller pads can move up and down to accommodate thigh movement;

the roller pads comprising means for providing a support surface for performing leg extension exercises and for holding down the legs when performing upper body exercises; and the frame including a base, an upright member projecting upwardly from the base, a seat supporting member projecting forwardly from the upright member and having a forward end, the seat assembly including a seat pad mounted on the seat supporting member, and at least one upright strut projecting upwardly from the base and having an upper end spaced forwardly from said seat pad, and the leg exercise arm and roller pad assembly are pivotally mounted to the upright strut.

5. The apparatus as claimed in claim 4, further comprising a second upright strut projecting upwardly from the base parallel to said first upright strut, wherein the leg exercise arm is pivotally mounted between said struts, the roller pad assembly comprises a pair of parallel support brackets each having a first end pivoted to said struts, and a second end, an axle secured across the second ends of said brackets, and the roller pads are secured over opposite ends of said axle.

6. The apparatus as claimed in claim 3, wherein said roller pads in said lowered position comprise means for positioning a user's knee pivot in substantial alignment with said first pivot axis.

7. The apparatus as claimed in claim 6, wherein said roller pad assembly is freely rotatable between said raised and lowered position.

8. An exercise apparatus comprising:

a support frame having a forward end and a rear end;

a seat assembly mounted on the frame for performing exercises in a seated position;

a resistance device mounted on the frame for providing resistance to exercises performed on the apparatus;

a leg exercise arm pivotally mounted on the frame at a location spaced forwardly from the seat assembly, the leg exercise arm is linked to the resistance device for providing resistance to leg exercises, and has leg engaging members for engagement by a user's legs when seated on the seat assembly to perform leg exercises;

a roller pad assembly pivotally mounted on the frame adjacent the leg exercise arm, and having a pair of roller pads for engaging a user's legs, the assembly is movable between a lowered position in which the roller pads are located behind a seated user's knees and a raised position in which the roller pads engage the top of a seated user's thighs, the roller pads resting freely on top of a user's thighs in said raised position, whereby said roller pads can move up and down to accommodate thigh movement;

the roller pads comprising means for providing a support surface for performing leg extension exercises and for holding down the legs when performing upper body exercises;

the frame includes a base, an upright member projecting upwardly from the base, a seat supporting member projecting forwardly from the upright member and having a forward end;

the seat assembly including a seat pad mounted on the seat supporting member, and at least one upright strut projecting upwardly from the base and having an upper end spaced forwardly from said seat pad, the leg exercise arm and roller pad assembly are pivotally mounted to the upright strut; and said upright strut has a central longitudinal axis, a rear edge parallel to said longitudinal axis, and a rearwardly facing, inclined upper edge having an upper end, the rear edge comprising a first stop for engaging the roller pad assembly to prevent further rotation beyond said lowered position, and the inclined upper edge comprising a second stop for engaging the roller pad assembly to prevent rotation beyond said raised position.

9. The apparatus as claimed in claim 8, wherein the roller pad assembly projects upwardly from the upper end of the upright strut in said raised position.

* * * * *